United States Patent [19]

Porter

[11] 4,333,330

[45] Jun. 8, 1982

[54] SPREADER TOOL

[75] Inventor: Thomas M. Porter, Concord, Mass.

[73] Assignee: H. K. Porter, Inc., Somerville, Mass.

[21] Appl. No.: 141,896

[22] Filed: Apr. 21, 1980

[51] Int. Cl.[3] ..... B66F 3/00

[52] U.S. Cl. ..... 72/392; 72/452; 72/705

[58] Field of Search ..... 72/392, 452, 705; 81/301, 302, 349, 383.5; 29/239, 252, 253; 254/104; 74/107

[56] References Cited

U.S. PATENT DOCUMENTS

| | | | |
|---|---|---|---|
| 1,530,227 | 3/1925 | Bourassa | 74/107 |
| 2,447,401 | 8/1948 | Ferguson et al. | 72/392 |
| 2,861,488 | 11/1958 | Barnes | 81/349 |
| 2,888,051 | 5/1959 | Burton | 254/104 |
| 3,819,153 | 6/1974 | Hurst et al. | 72/392 |

FOREIGN PATENT DOCUMENTS

| | | | |
|---|---|---|---|
| 2418271 | 1/1976 | Fed. Rep. of Germany | 72/452 |

*Primary Examiner*—Lowell A. Larson
*Attorney, Agent, or Firm*—Henry C. Nields

[57] ABSTRACT

A spreader tool having opposed force arms separately pivotally mounted on a base member for annular movement in opposite directions in response to axial movement of a driven piston of an associated jack wherein the inner edges of the force arms bear upon roller means mounted on the forward end of the piston. The curve of the inner edge of the force arms is preferably so constructed that the angle at which a constant axial force of the piston is applied to the force arm by the roller means is always such that the force applied to the load by the force arm is constant.

6 Claims, 6 Drawing Figures

158
150
153
164
160
162
166
152
156
154
104
102
96
86
90
50
106
78
80
48
10
33
12
23c
23b
14
4
6
8

SPREADER TOOL

BACKGROUND

1. Field of Invention

The present invention relates generally to force exerting apparatus and more particularly to a new and improved spreader tool of the type wherein force arms are urged apart by the influence of an axially driven piston which tool may be designed to apply a force to a load which is directly proportional to the axial force of the piston throughout its spreading cycle, or to cause a rate of spreading movement of the force arms which is directly proportional to the rate of axial movement of the piston of the jack, or to produce predetermined variations in the applied force to the load and in the rate of spreading movement of the force arms over the course of the spreading cycle of the tool depending upon the geometrical configuration chosen for the edges of the force arms which engage the piston as hereinafter more fully appears.

2. Brief Description of the Prior Art

It has long been recognized that force exerting devices of the spreader type are useful in connection with the repair of deformed automobile bodies and other structures, and as rescue tools in a wide variety of emergency and accident situations. The principal advantage of such tools resides in the facts that such tools may be lightweight and weildy yet powerful devices capable of use in tight places such as by insertion into narrow crevices in the body of a construction to apply against the sides of same a force derived from the force of a powerful force generating mechanism such as a hydraulic jack. To accomplish this spreader tools have heretofore relied upon numerous variations of a simple linkage method of driving annularly movable force arms with an axially moving piston.

Basically devices of this type consist a fluid operated cylinder, a base member mounted on the forward end of the cylinder, a piston mounted for axial movement in the cylinder extending through the forward end thereof, a pair of force arms pivotally mounted on the base on opposite sides of the cylinder, and a pair of lever arms pivotally connected to the forward end of the piston at one end thereof and pivotally connected to one or the other of the force arms respectively at the other ends thereof such that axial movement of the piston controls the separation of the nonsecured ends of the force arms. Examples of this type of construction are shown in U.S. Pat. No. 265,549 to Urie; U.S. Pat. No. 2,341,278 to Long; U.S. Pat. No. 2,447,401 to Ferguson; U.S. Pat. No. 2,643,562 to Geddes; U.S. Pat. No. 2,497,836 to Miller; and U.S. Pat. No. 3,819,153 to Hurst.

It will be understood that the geometry of devices of the type just described is such that the spreading force, that is that portion of the force applied by the piston which is conveyed to the force arms by the lever arms so as to act at 90° to the axial direction of piston movement, increases as the nonsecured ends of the force arms move away from each other while the rate at which this separation occurs decreases. These geometrical limitations severely effect the efficiency of tools of this type.

Consider, for example, an attempt to open a crash jammed door, to separate crash entangled vehicles, to right an overturned automobile, or even to reshape a deformed fender. In each of these cases the force necessary during the job seldom exceeds the force necessary to initiate movement of the load; yet present spreader devices apply their minimum force initially, increasing force and decreasing spreading rate throughout the spreading cycle. Accordingly, the axial force applied by the piston of such devices must be initially high in order to produce a spreading force adequate to move the load, yet in the typical case, wherein the axial force applied by the piston is constant throughout the spreading cycle, this means that as the spreading cycle continues the spreading force inefficiently exceeds that force necessary to move the load by greater and greater amounts. This may, of course, be avoided by the provision of a drive mechanism for the piston which is variable in relation to the variation in spreading force over the spreading cycle, but such a mechanism is undesirable in this context due to the complexity and weight it adds to such a device. Additionally, the hydraulic pressures which must be generated and maintained to supply the axial forces such devices require are also high requiring expensive and cumbersome equipment for their generation; constant care in the design and maintenance of connecting lines and joints; and careful design of the tool itself in order to avoid stress failures.

SUMMARY OF THE PRESENT INVENTION

The present invention provides a new and improved spreader tool which preferably exerts a constant force against a load in response to a constant level of applied axial force, but also may be designed to exhibit a rate of spreading which is directly proportional to the rate of piston extension or to produce predetermined variations in both applied force and rate of spreading over the spreading cycle. More specifically, the present invention provides a spreader tool having opposed force arms pivotally mounted on a base member for annular movement in opposite directions in response to the axial movement of a driven piston of an associated jack wherein the inner edges of the force arms are preferably curved and bear upon roller means mounted on the forward end of the piston. The curve of the inner edge of the force arms is preferably so constructed that the angle at which a constant axial force of the piston is applied to the force arm by the roller means is always such that the force applied to the load by the force arm is constant.

It is thus an object of the present invention to provide a new and improved spreader tool which is capable in response to a constant level of input force of applying a constant force against a load throughout its spreading cycle.

It is also an object of the present invention to provide a spreader tool of the type described in which by modification of the configuration of the edges of the force arms which bear upon the piston the rate of spreading of the force arms may be made directly proportional to the rate of extension of the piston of the jack, or predetermined variations in applied force and rate of spreading can be achieved.

It is further an object of the present invention to provide a spreader tool of the type described suitable for repair and rescue work requiring the exertion of spreading forces, particularly in cases requiring the exertion of such forces upon the sides of narrow crevices and the like.

Another object of the present invention is to provide a spreader tool of the type described which is lightweight and weildy yet strong enough to withstand the stress of all loads within its power capability without damage.

Another object of the present invention is to provide a spreader tool which is capable of providing an output to the load which is directly proportional to the input supplied.

BRIEF DESCRIPTION OF THE DRAWINGS

These as well as other features, objects, and advantages of the present invention, will be more clearly understood by reference to the following description of a preferred embodiment of the present invention and to the drawings in which.

DETAILED DESCRIPTION OF PREFERRED EMBODIMENT

Figure 1:
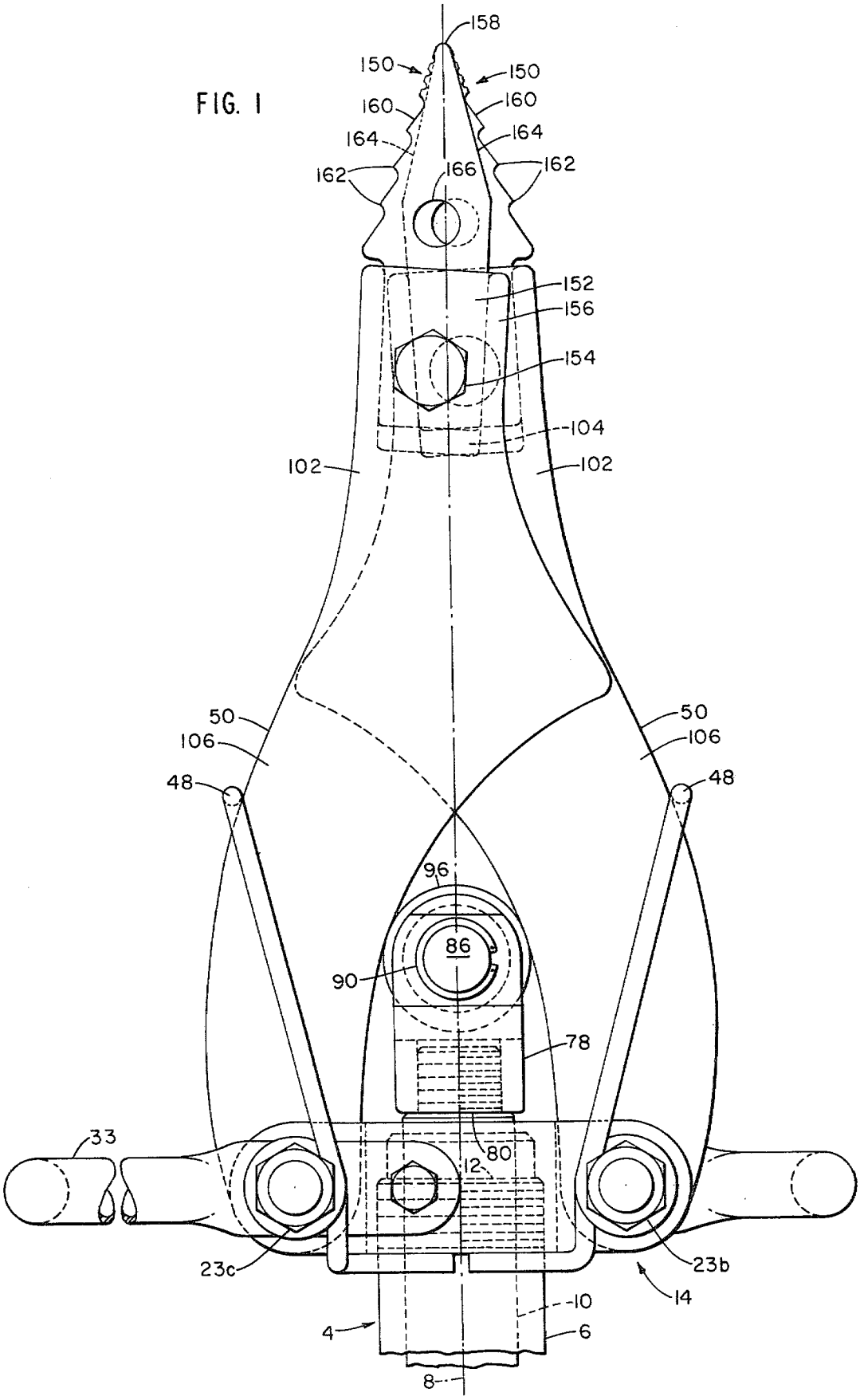
FIG. 1 is a rear elevation of a device in accordance with the present invention in the closed position.
Figure 2:
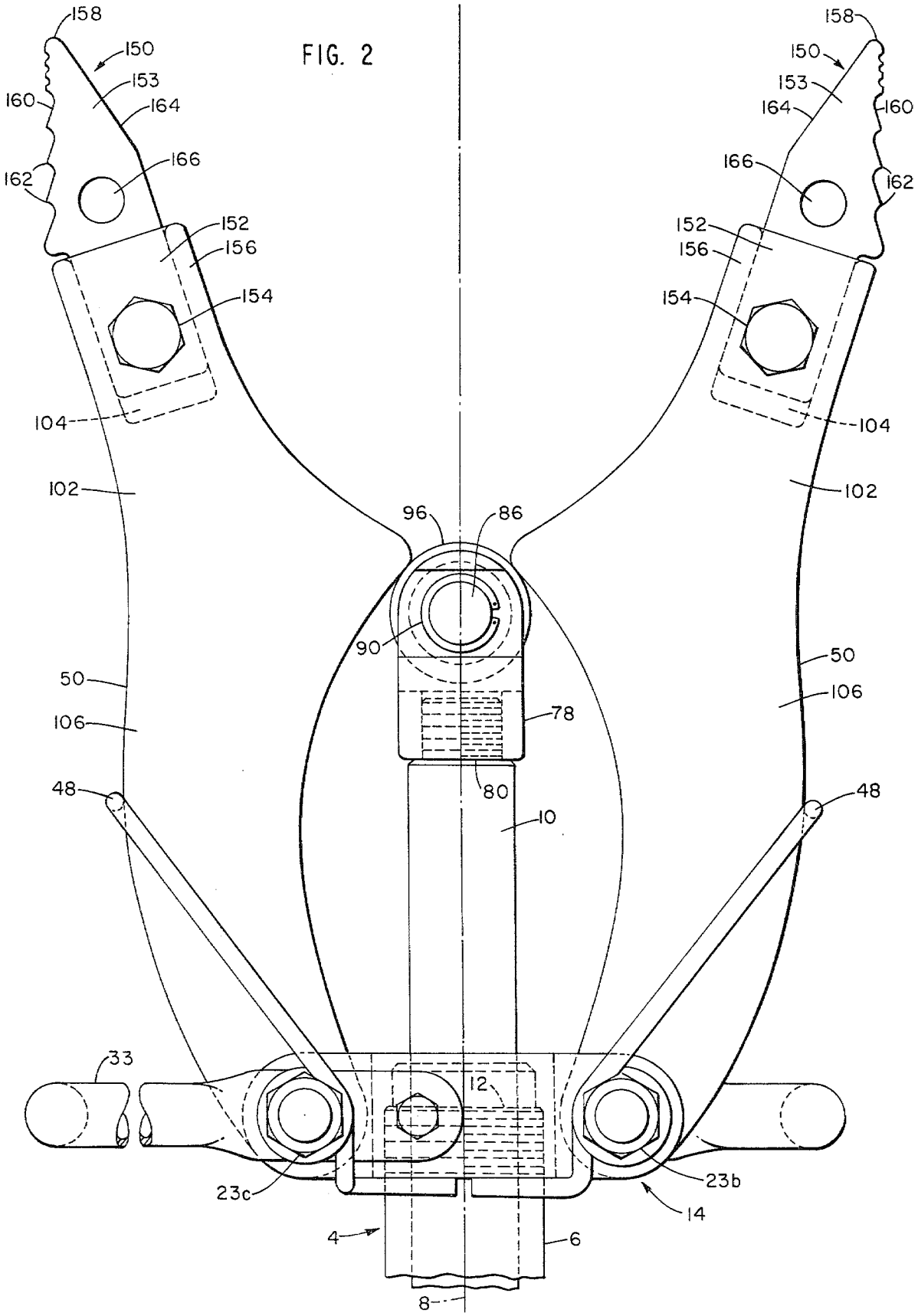
FIG. 2 is a rear elevation of the device shown in FIG. 1 in the maximum open position.

Referring now specifically to the drawings, wherein like reference numerals are used to designate like elements throughout, there is shown a preferred embodiment of a spreader tool in accordance with the present invention. The tool, generally indicated at 2, is best seen in the rear elevational views of FIG. 1 and FIG. 2; FIG. 1 showing the tool in closed position and FIG. 2 showing the tool in the maximum open position.

In accordance with the present invention a fluid operated jack of conventional construction, generally indicated at 4 and shown only in operationally significant portion, is provided as a source of axial force and as a base with which the remaining elements of the tool are associated for the ultimate application of a constant force (assuming constant axial force) to a load (not shown). The jack 4 generally comprises a stationary cylinder 6 having a longitudinal axis 8 and a piston element 10 mounted in the forward end 12 of the cylinder 6 for axial movement along longitudinal axis 8 between positions of maximum (FIG. 1) and minimum (FIG. 2) engagement with the cylinder 6.

Figure 4:
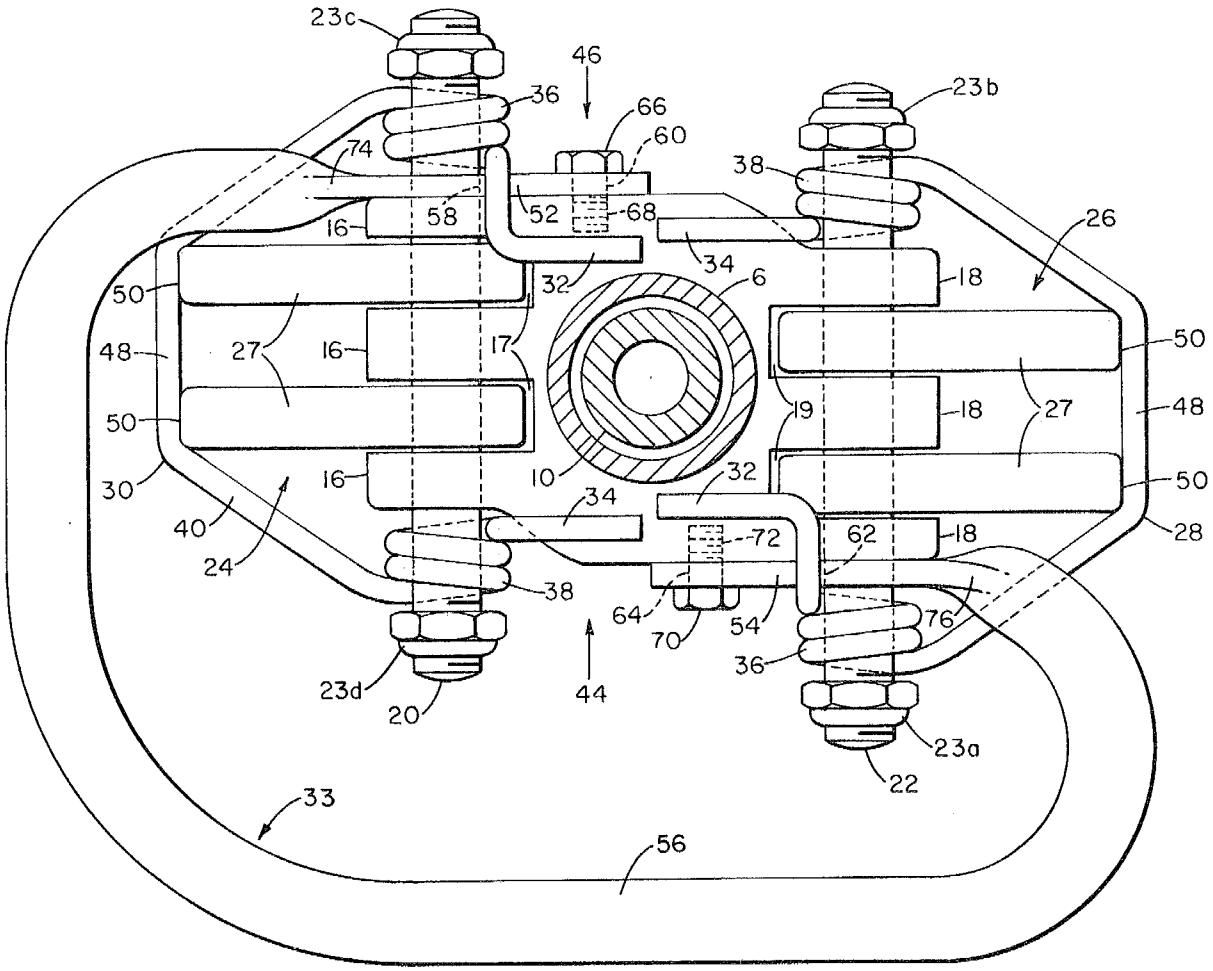
FIG. 4 is a view of the bottom of the device shown in FIG. 1.

A support member, generally indicated at 14, and best seen in FIG. 4, is mounted on the forward end 12 of cylinder 6 by welding, screw-thread engagement, or other suitable means which will hold support member 14 substantially stationary relative to the cylinder 6. Support member 14 is adapted to allow the movement of piston 10 therethrough as above described and is provided on opposite sides of the cylinder 6 with outwardly extending spaced projections, 16 and 18 respectively, projections 16 being opposite the spaces 19 between the projections 18. Projections 16 and 18 are adapted to receive pivot pins 20 and 22 respectively along parallel axes located in a plane parallel to the plane containing the forward end 12 of cylinder 6. Pins 20 and 22 are threaded at both ends and are held in place by nuts 23*a*, 23*b*, 23*c*, and 23*d*. Left and right force arms, generally indicated at 24 and 26 respectively, each comprising two identical spaced flat elements 27 which are pivotally mounted on the pivot pins 20 and 22 respectively, one element 27 in each of the spaces 17 and 19 between projections 16 and 18 as best seen in FIG. 4. The number of projections 16 and 18, spaces 17 and 19, and elements 27 may all of course vary in accordance with considerations such as tool weight, wieldiness, and the weight, type and geometric configuration of the load without departure from the present invention. Also mounted on pivot pins 20 and 22 are spring loaded arm closing elements 28 and 30 and handle 33.

Arm closing elements 28 and 30 each comprise anchor portions 32 and 34, spring portions 36 and 38, and upwardly extending brace portion 40. For convenience, only the positioning of closing element 28 will be described relative to the front 44 of the tool, it being understood that the positioning of closing element 30 is contemplated to be the same when viewed from the opposite side of the tool. Starting from anchor portion 32 which extends below and bears against the bottom 42 of support member 14 adjacent the front 44 of the tool, closing element 28 extends upward and forms a counterclockwise coil about pivot pin 22 in spring portion 36 immediately inward of nut 28*a*. Similarly anchor portion 34 extends below and bears against the bottom 42 of support member 14 adjacent the rear 46 of the tool, closing element 28 extending upwardly therefrom to form a clockwise coil about pivot pin 22 in spring portion 38 immediately inward of nut 23*b*. Brace portion 40 connects spring portions 36 and 38 forming an upwardly sloping U shape the base 48 of which bears against the outer edges 50 of the elements 27 forming force arm 26.

The handle 33 (best seen in FIG. 4) comprises flange portions 52 and 54 and grip portion 56. Flange portions 52 and 54 contain adjacent apertures 58 and 60 and 62 and 64 respectively, flange 52 being mounted on pivot pin 20 between the rear 46 of the tool and spring portion 36 of arm closing element 30 and fixed to the rear 46 of the tool by screw bolt 66 extending through aperture 60 engaging threaded cavity 68 in the rear support member 14, and flange 54 being mounted on pivot pin 22 between the front 44 of the tool and spring portion 36 of arm closing element 28 and fixed to the front 44 of the tool by screw bolt 70 extending through aperture 64 engaging threaded cavity 72 in the front of support member 14. Grip portion 56 connects end 74 of flange 52 to end 76 of flange 54 outwardly of the periphery of the tool in the plane containing the parallel axes of pivot pins 20 and 22.

Figure 3:
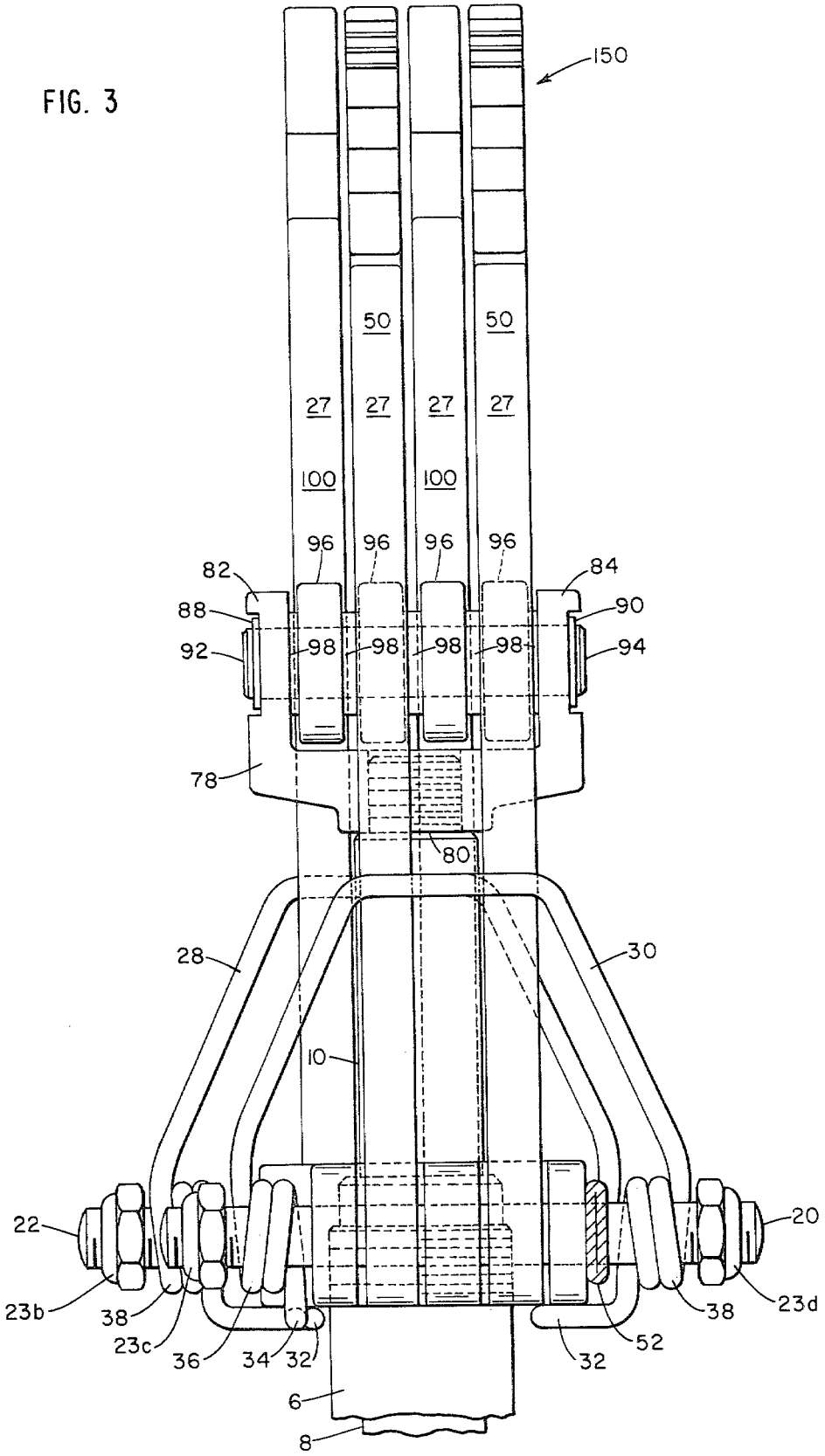
FIG. 3 is a left side elevation of the device shown in FIG. 1.

A roller bracket, generally indicated at 78 and best seen in FIG. 3, of substantially U-shape is mounted on the forward end 80 of piston 10 by welding, screw-thread engagement or other suitable means which will hold the roller bracket fixed relative to the piston such that upwardly extending portions 82 and 84 of roller bracket 78 are parallel to each other and to elements 27. Portions 82 and 84 of roller bracket 78 are adapted to receive a roller pin 86 along an axis parallel to the axes of pivot pins 20 and 22, the roller pin 86 being maintained in place by C-type snap rings 88 and 90 engaging grooves (not shown) adjacent ends 92 and 94 of roller pin 86. Rotatably mounted on roller pin 86 between portions 82 and 84 of roller bracket 78 are a series, equal in number to the number of elements 27, of substantially identical wheel-like roller elements 96 separated from each other and from portions 82 and 84 of roller bracket 78 by spacer elements 98 such that each roller element 96 bears against the inner edge 100 of a separate element 27 of one of the force arms.

Returning now to the force arms 24 and 26, it will be seen with reference to FIG. 1 and FIG. 2 that each element 27 of each force arm has a tapered distal portion 102 which terminates in a tip receiving cavity 104. Tips 150 comprise mounting portion 152 and load engaging portion 153. Mounting portion 152 is adapted to fit into cavity 104 and to be held in place by flat round head socket cap screw 154 which passes through an aperture (not shown) in the rear portion of wall 156 surrounding cavity 104 and engages the front portion wall 156 in screw-thread relation. Load engaging portion 153 extends outward of cavity 104 and is tapered to a narrow end 158 which is centered upon longitudinal axis 8 when the tool is closed. Tips 150 also have work bearing edges 160 which extend from immediately above outer edges 50 of elements 27 to said narrow ends 158, these work bearing edges being ridged normal to the direction of their extension to form teeth 162 which aid in preventing slipping of the load or disengagement of edges 160 therefrom during operation of the tool. The other edges 164 of tip 150 may be sharpened such that the tool may be used for cutting by simply reversing the position of the tip 150 in cavity 104. Similarly, tip 150 may also have aperture 166 therethrough to facilitate attachment of a chain or cable thereto as the particular context of use may require.

Figure 5:
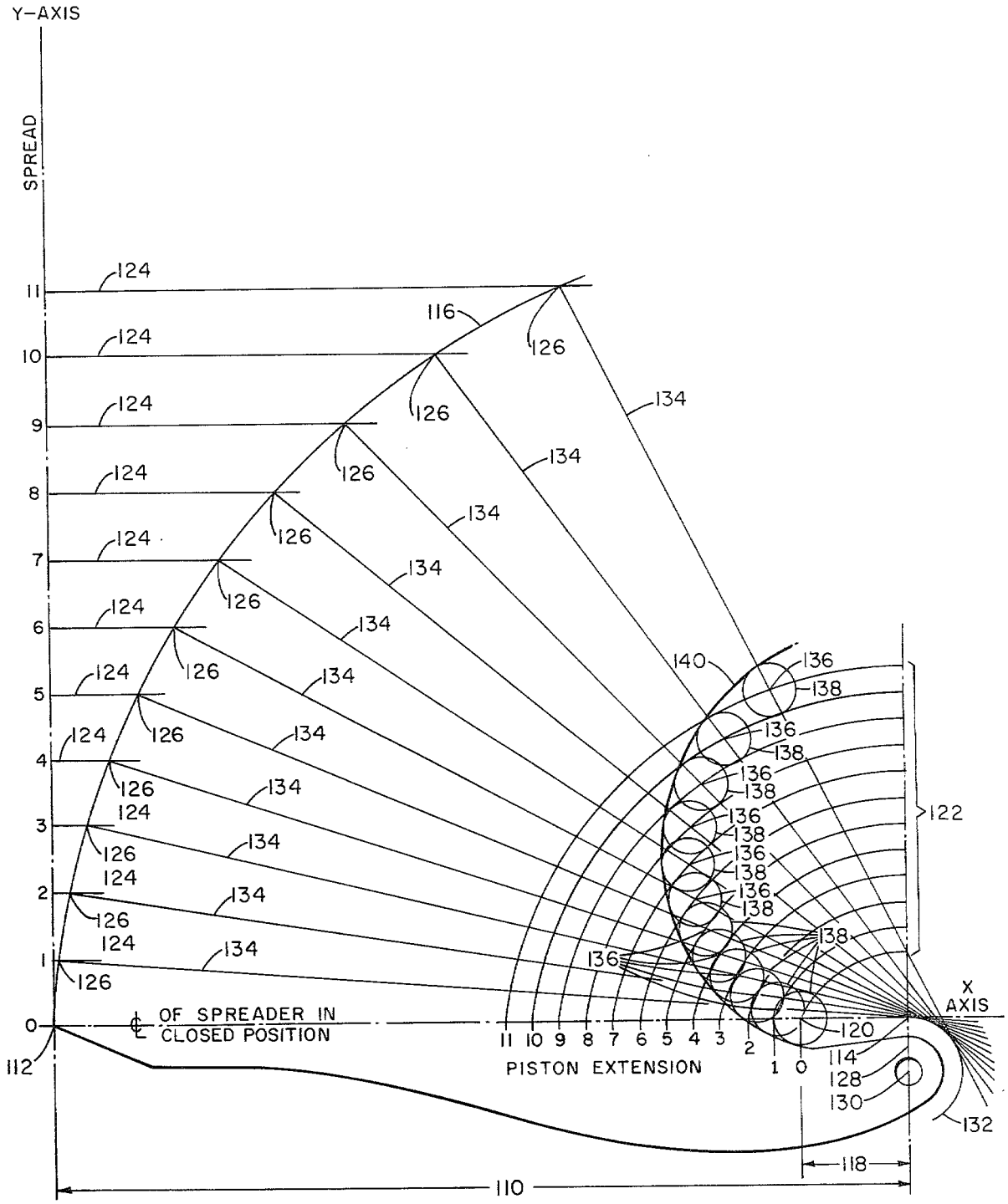
FIG. 5 is a geometric derivation of a curve suitable for use as the inner edge of a force arm in accordance with the present invention.

Each element 27 also has a proximal portion 106 the inner edge 100 of which curves inward and extends over a roller element 96 (when the tool is in the closed FIG. 1 position) as it rises from its respective pivot pin to the distal portion 102. In the embodiment shown the proximal portion 106 also gradually widens as it rises from the pivot pin to the distal portion. The curve of that portion of inner edge 100 associated with proximal portion 106 is in this embodiment, a portion of a spiral which may conveniently be derived geometrically as shown either in FIG. 5 or in FIG. 6. In FIG. 5 this derivation proceeds as follows: letting longitudinal axis 8 represent the x-axis and the y-axis be the direction of spread of the force arms normal to longitudinal axis 8, a distance 110 equivalent to the height of the force arm from the axis of its pivot pin to the end of its tip is measured from the intersection 112 of the x and y axes along the x-axis, thereby defining the point 114.

Figure 6:
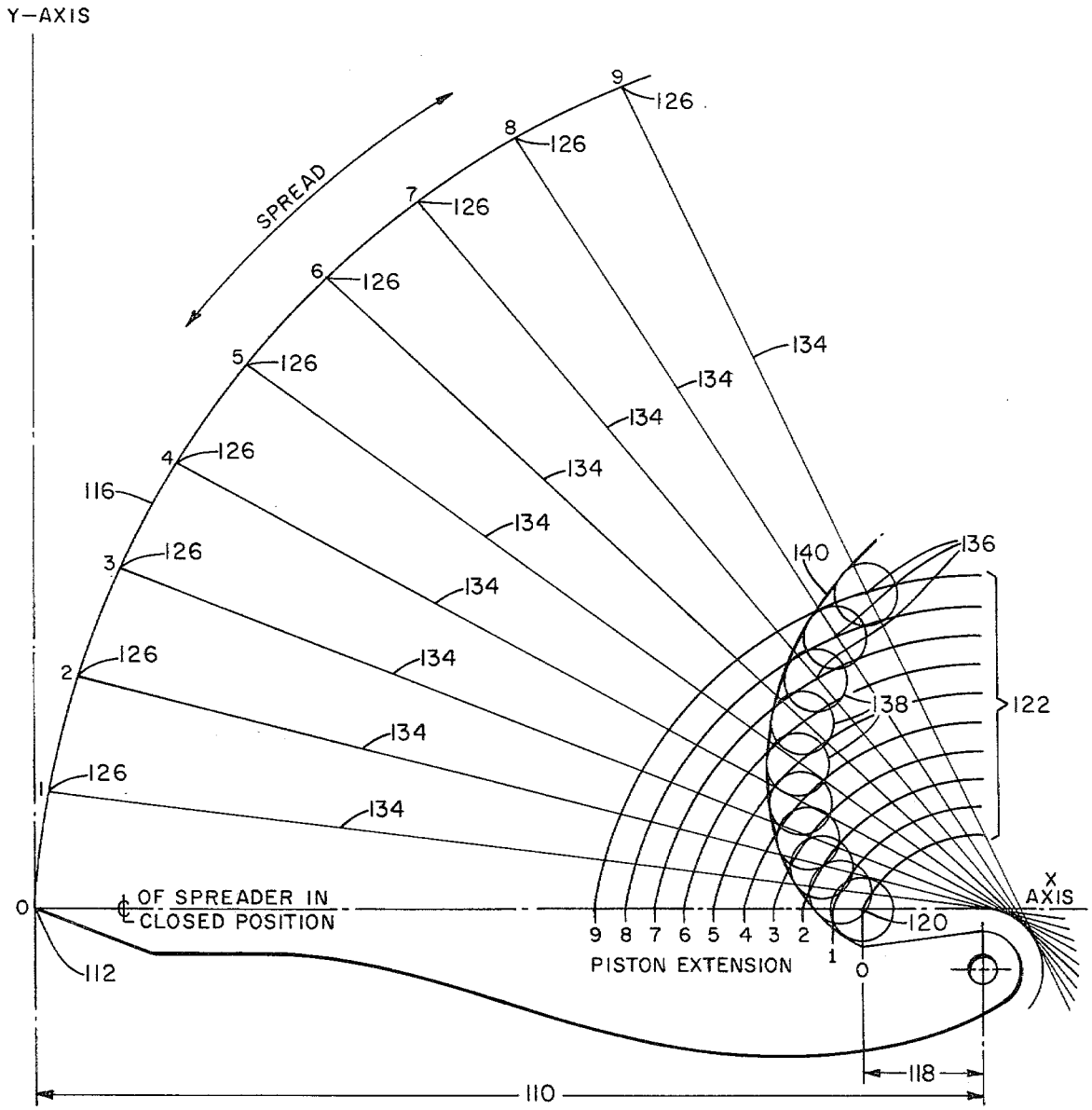
FIG. 6 is an alternative geometric derivation of a second curve also suitable for use as the inner edge of a force arm in accordance with the present invention.

A line 128 normal to the x-axis is drawn from point 114 in the negative y direction a distance equivalent to that between longitudinal axis 8 and the axis of a pivot pin, thereby determining point 130. Using point 130 as a center and the length of line 128 as a radius an arc 132 is then drawn in the fourth quadrant starting from the x axis-line 128 intersection and extending to the right through at least 90°. Also using point 130 as a center point an arc 116 is drawn in the first quadrant of the x-y plane having a radius equal to the distance between point 130 and point 112. A distance 118 equivalent to that between the plane containing the axes of pins 20 and 22 the axis of pin 86 when the tool is closed as in FIG. 1 is then measured from the point 114 toward the intersection 112 of the x-y axes along the x axis, the point 120 thus determined acting as a second center point about which a circle is drawn of radius equivalent to that of roller elements 96. The desired ratio of tip movement in the y direction to piston movement along longitudinal axis 8 is then selected, and units reflecting this ratio are marked on the positive y axis starting from the x-y axis intersection 112 and on the x-axis starting from the second center point 120 and extending toward the x-y axis intersection 112. Arcs 122 having a center point 130 and radii equal to the distance between point 130 and consecutive markings on the x-axis, are drawn in the first quadrant. Lines 124, parallel to the x axis, are drawn through the points marked on the y axis, thereby defining points 126 where lines 124 intersect arc 116. Lines 134 are then drawn through points 126 tangent to arc 132. The points 136 where lines 134 intersect their related arcs 122 then become center points for circles 138 of radius equivalent to roller element 96. The curve 140 is then drawn tangent to each of the circles 138 as shown in FIG. 5. The curve 140 is carried through a much longer arc than is actually used in the actual tool simply for purposes of illustration. The derivation shown in FIG. 6 is similar, the only difference being that the distance of spread is measured along arc 116 rather than the y axis. Outline 142 is provided in both FIG. 5 and FIG. 6 merely to aid in visualizing the relationship of the geometry shown therein to elements 27.

It will thus be seen that in operation, assuming the desirability of the exertion of equal and opposite forces by arm closing elements 22 and 30, a constant level hydraulic pressure is applied to cylinder 6 thence urging piston 10 upward from the position shown in FIG. 1. As the piston moves upward from the position shown in FIG. 1 to that shown in FIG. 2 the roller elements roll along edges 100 and force tips 150 apart against the force of arm closing elements 28 and 30 and the load. It will also be seen, particularly from FIG. 5 and FIG. 6, that the angle, to a plane parallel to the plane containing the axes of pivot pins 20 and 22 passing through the axis of pin 86, at which the force of the piston is applied to edges 100 by roller means 96 varies directly with the change in perpendicular separation between the above planes. Thus, the output force, that is the force exerted by the tips against the load is constant throughout the spreading cycle. Once the maximum spread, FIG. 2, is reached the hydraulic pressure is released and the piston 10 is retracted into the cylinder 6 by an internal spring (not shown). Arm closing elements 28 and 30 push inward on force arms 24 and 26, thereby maintaining the engagement of roller elements 96 on edges 100 as piston 10 is retracted into cylinder 6 returning the tool to the position shown in FIG. 1.

It should be understood in the above regard that this tool is adaptable to the provision of a constant rate of spread of the force arms. Similarly, it is possible to achieve substantially any combination of rate of spread and level of applied force over the course of the spreading cycle, except constant applied force and uniform rate of spread at the same time, by appropriate selection of the curves of edges 100.

The mode of operation of the preferred embodiment of the tool described herein is thus not only efficient in that it yields constant output for constant input but it is safer as well. Arm closing elements 28 and 30 tend to prevent elements 27 from wavering from the vertical and spacer elements (now shown) may be added between the elements of each arm if the problem becomes acute. Further, unlike prior tools of this type, the present device provides maximum leverage and mechanical advantage initially and throughout its powered spreading.

It should further be understood that the embodiments and practices described and portrayed herein have been presented by way of disclosure, rather than limitation, and that various substitutions, modification and combinations may be effected without departure from the spirit and scope of this invention in its broader aspects.

I claim:

1. A spreader tool for providing a controlled level of force in operation, the tool comprising a fluid operated jack, said jack comprising a cylinder having a longitudinal axis and a open forward end and a piston element having a forward end operatively disposed for axial movement in said open forward end of said cylinder; first support means mounted on said forward end of said piston; at least two roller means mounted in spaced adjacent relation on said first support means such that their common axis of rotation is normal to the longitudinal axis of said cylinder; second support means mounted about the periphery of said open forward end of said cylinder; and a pair of force arms separately, pivotally mounted on said second support means on opposite sides of said cylinder about pivot axes which are parallel to each other and to said axis of rotation of said roller means, each said force arm having a distal load engaging portion and a curved inner edge extending over and bearing against one of said roller means, whereby axial movement of said piston out of said cylinder will cause the respective roller means to roll along the inner edges of the respective force arms forcing same apart and the curvature of said inner edges being such that said force transmitted from said jack to said force arms is controlled.

2. The spreader tool of claim 1 wherein each force arm comprises at least one spaced flat element, the elements of one arm being opposite the spaces between the elements of the other arm.

3. The spreader tool of claim 1 or claim 2 wherein the curve of said inner edge is so constructed that the rate of spread of the force arms is directly proportional to the rate of piston movement.

4. The spreader tool of claim 1 or claim 2 wherein the curve of said inner edge is so constructed that the force exerted by the force arms against a load is directly proportional to the force of the piston measured along the longitudinal axis of the cylinder.

5. The spreader tool of claim 1 or claim 2 or claim 3 or claim 4 wherein the distal load engaging portions of the force arms are adapted to fit between and act against opposing walls forming a narrow opening.

6. The spreader tool of claim 1 or claim 2 or claim 3 or claim 4 wherein the distal portions of each force arm are adapted to receive detachable tip portions.

* * * * *